US006921352B1

(12) United States Patent
Stearns

(10) Patent No.: US 6,921,352 B1
(45) Date of Patent: Jul. 26, 2005

(54) WRIST AND FOREARM EXERCISE METHODS AND APPARATUS

(76) Inventor: Kenneth W. Stearns, P.O. Box 55912, Houston, TX (US) 77055

( * ) Notice: Subject to any disclaimer, the term of this patent is extended or adjusted under 35 U.S.C. 154(b) by 315 days.

(21) Appl. No.: 10/144,230

(22) Filed: May 9, 2002

(51) Int. Cl.[7] ..... A63B 21/00

(52) U.S. Cl. ..... 482/44; 482/45

(58) Field of Search ..... 601/40, 89, 93, 601/97, 101, 103, 104, 27, 3, 1, 35; 602/21, 602/20, 32, 22; 482/44–46, 123, 129; 128/878, 128/879

(56) References Cited

U.S. PATENT DOCUMENTS

| | | | | |
|---|---|---|---|---|
| 3,019,019 | A * | 1/1962 | Forte | 482/94 |
| 4,589,655 | A * | 5/1986 | Ammon | |
| 5,067,479 | A * | 11/1991 | Saringer et al. | |
| 5,613,927 | A * | 3/1997 | Rothacker | 482/123 |
| 5,620,410 | A * | 4/1997 | Kaiser et al. | |
| 5,683,351 | A * | 11/1997 | Kaiser et al. | |
| 6,146,341 | A * | 11/2000 | Sato et al. | |

* cited by examiner

*Primary Examiner*—Jerome W. Donnelly

(57) ABSTRACT

An exercise device has a frame configured to engage a person's forearm, and a handle that is mounted on the frame for movement about at least two orthogonal axes relative to the frame and/or for movement in at least two orthogonal directions relative to the frame. The handle is preferably biased against movement out of a rest position relative to the frame.

13 Claims, 10 Drawing Sheets

WRIST AND FOREARM EXERCISE METHODS AND APPARATUS

FIELD OF THE INVENTION

Figure 1:
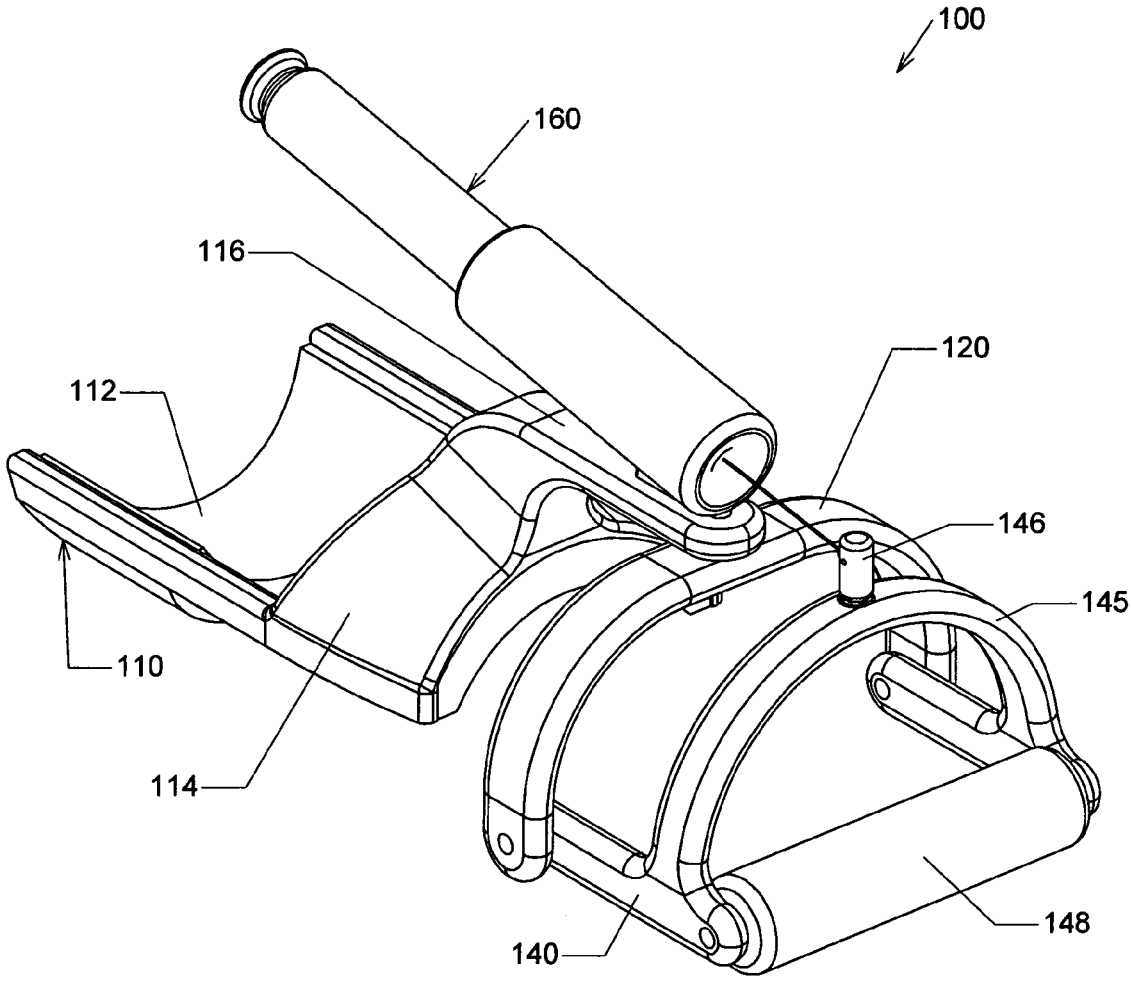

The present invention relates to exercise methods and apparatus, and more specifically, to the exercise of a person's wrist and forearm.

BACKGROUND OF THE INVENTION

Various devices exist to facilitate exercise of a person's wrist and forearm. Examples of such devices are disclosed in U.S. Pat. No. 4,589,655 to Ammon and U.S. Pat. No. 5,454,769 to Chen. These devices may generally be considered as satisfactory for performing limited motion exercises along the lines of wrist curls and inverted wrist curls or wrist extensions. However, these specific motions are not directly applicable to a wide range of real life activities. In other words, a need remains for a versatile yet relatively simple device suitable for accommodating various exercise motions involving a person's wrist and forearm.

SUMMARY OF THE INVENTION

The present invention provides exercise apparatus and methods suitable for accommodating numerous sorts of wrist and forearm motions. Various embodiments of the present invention include a frame configured to engage a person's forearm, and a handle that is movably mounted on the frame for movement in at least two orthogonal directions relative to the frame. Some sort of resistance device or bias force is preferably provided to resist movement of the handle relative to the frame. Many of the features and advantages of the present invention will become apparent to those skilled in the art from the more detailed description that follows.

BRIEF DESCRIPTION OF THE FIGURE OF THE DRAWING

Figure 2:
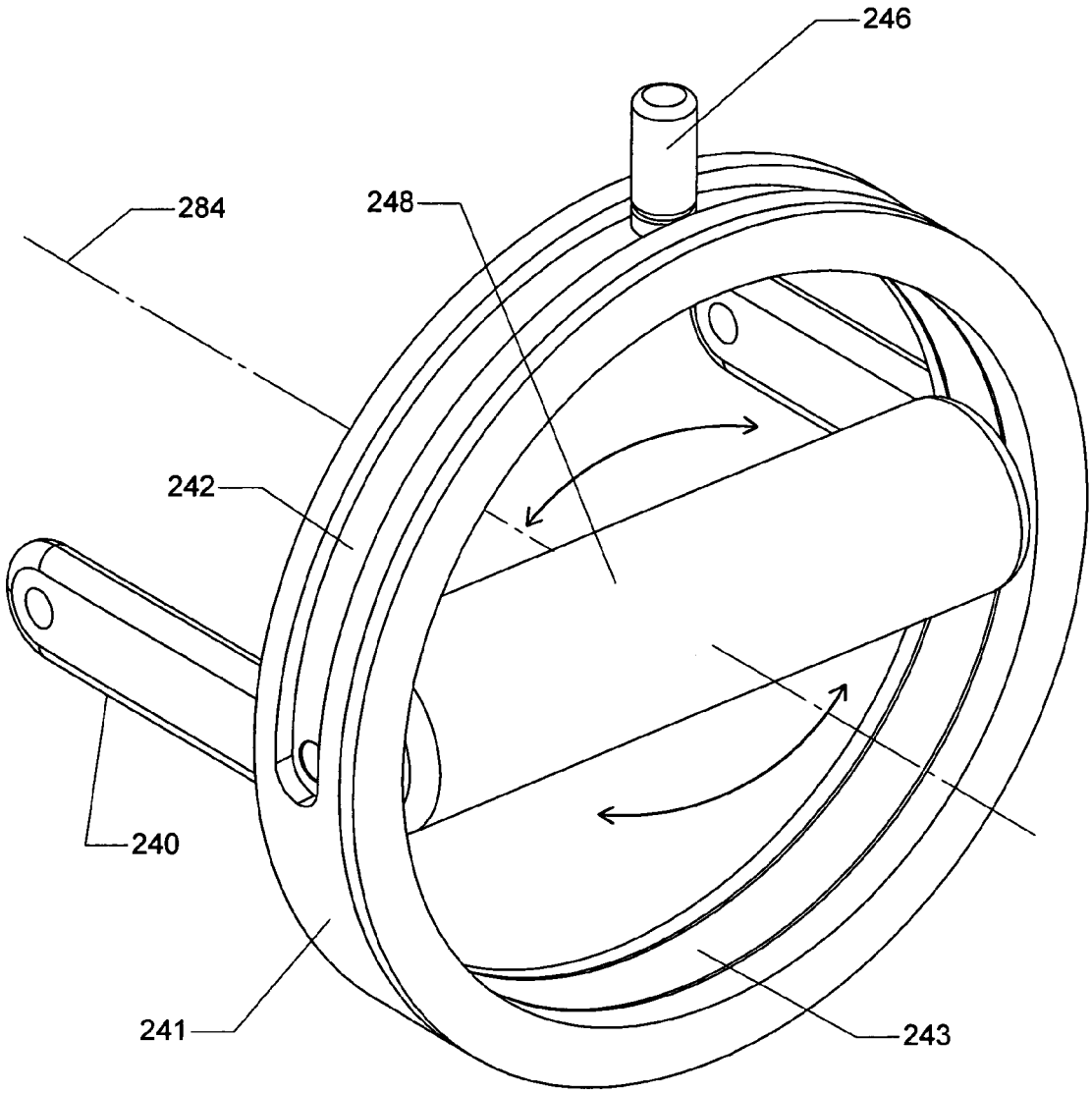
Figure 3A:
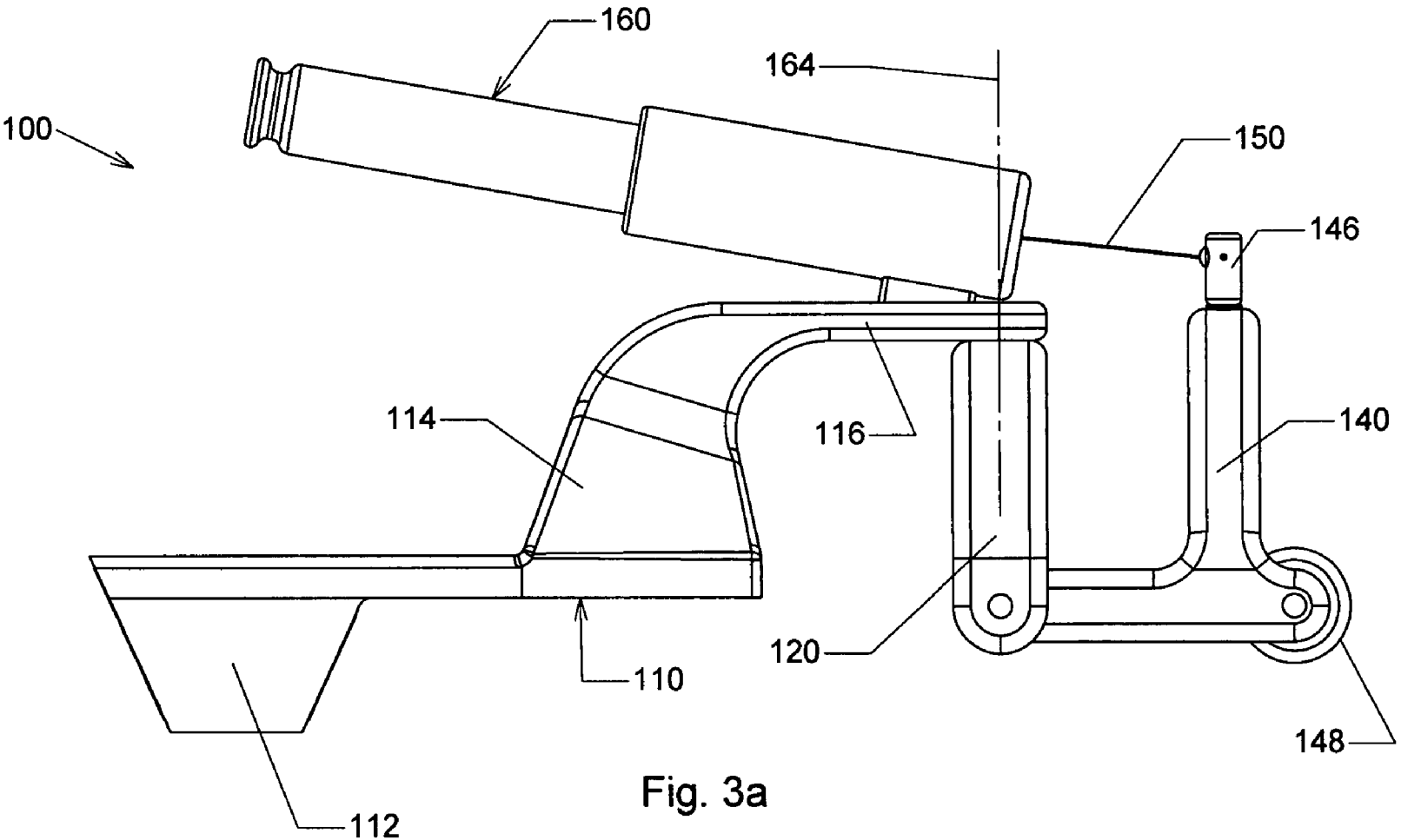
Figure 3B:
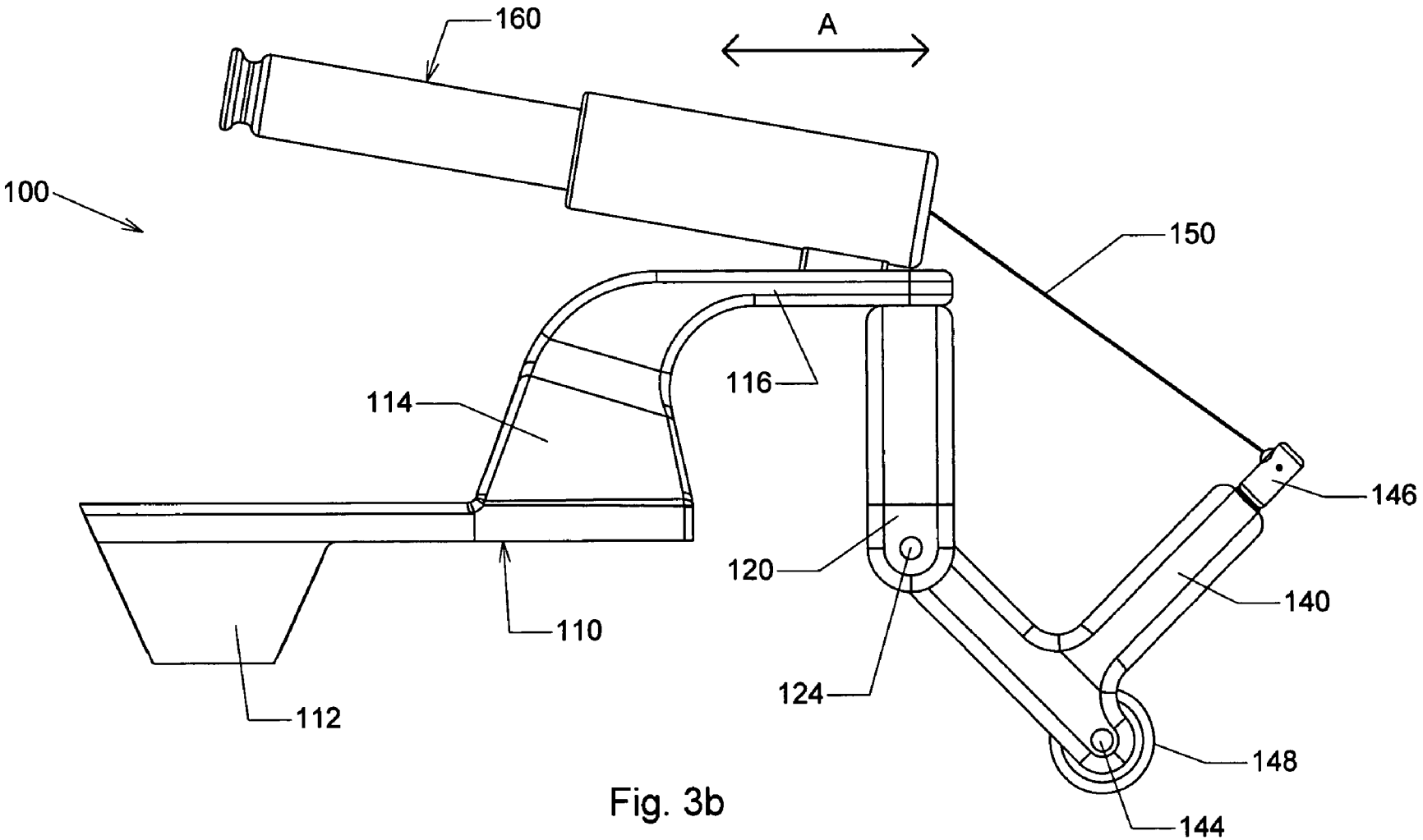
Figure 4A:
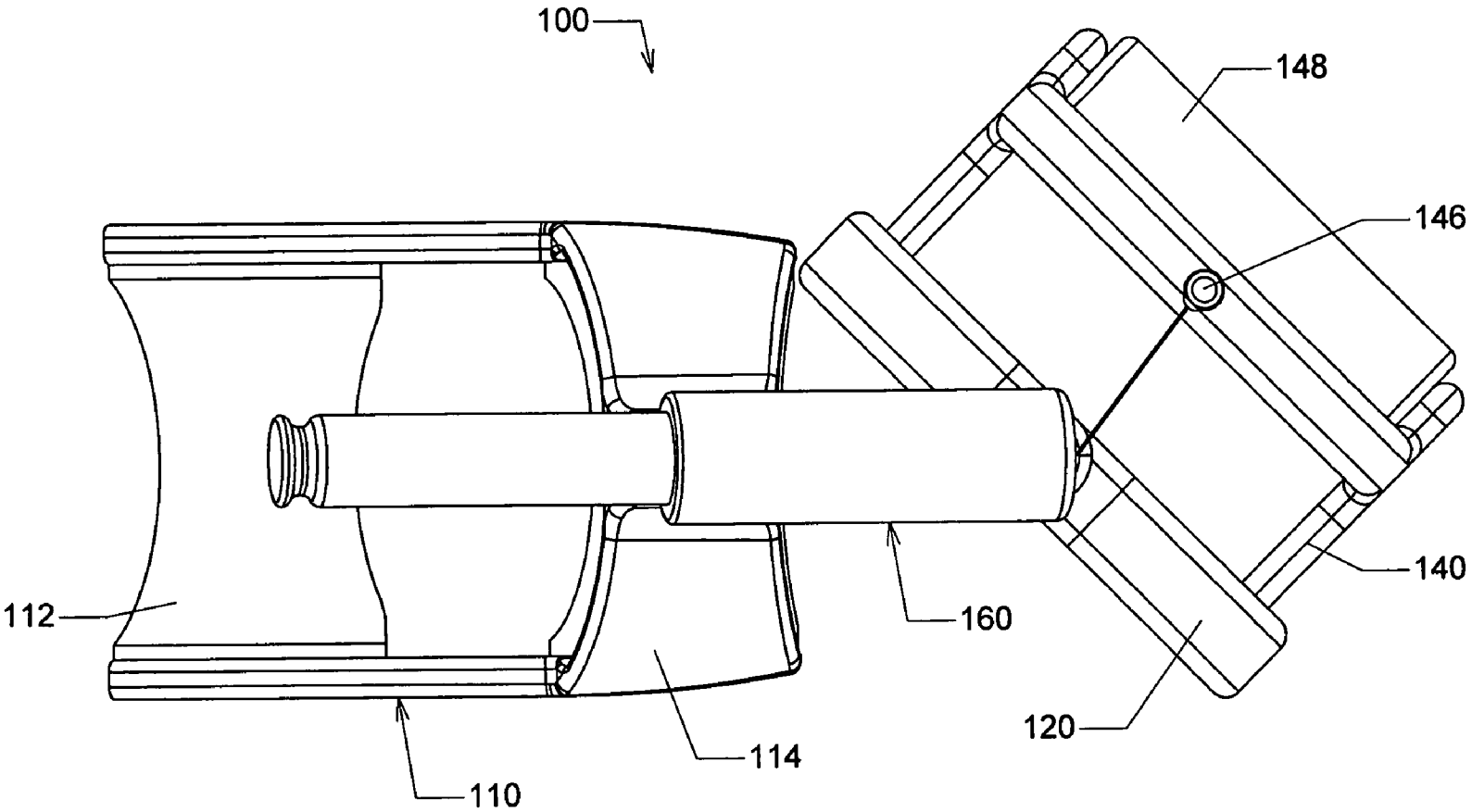
Figure 4B:
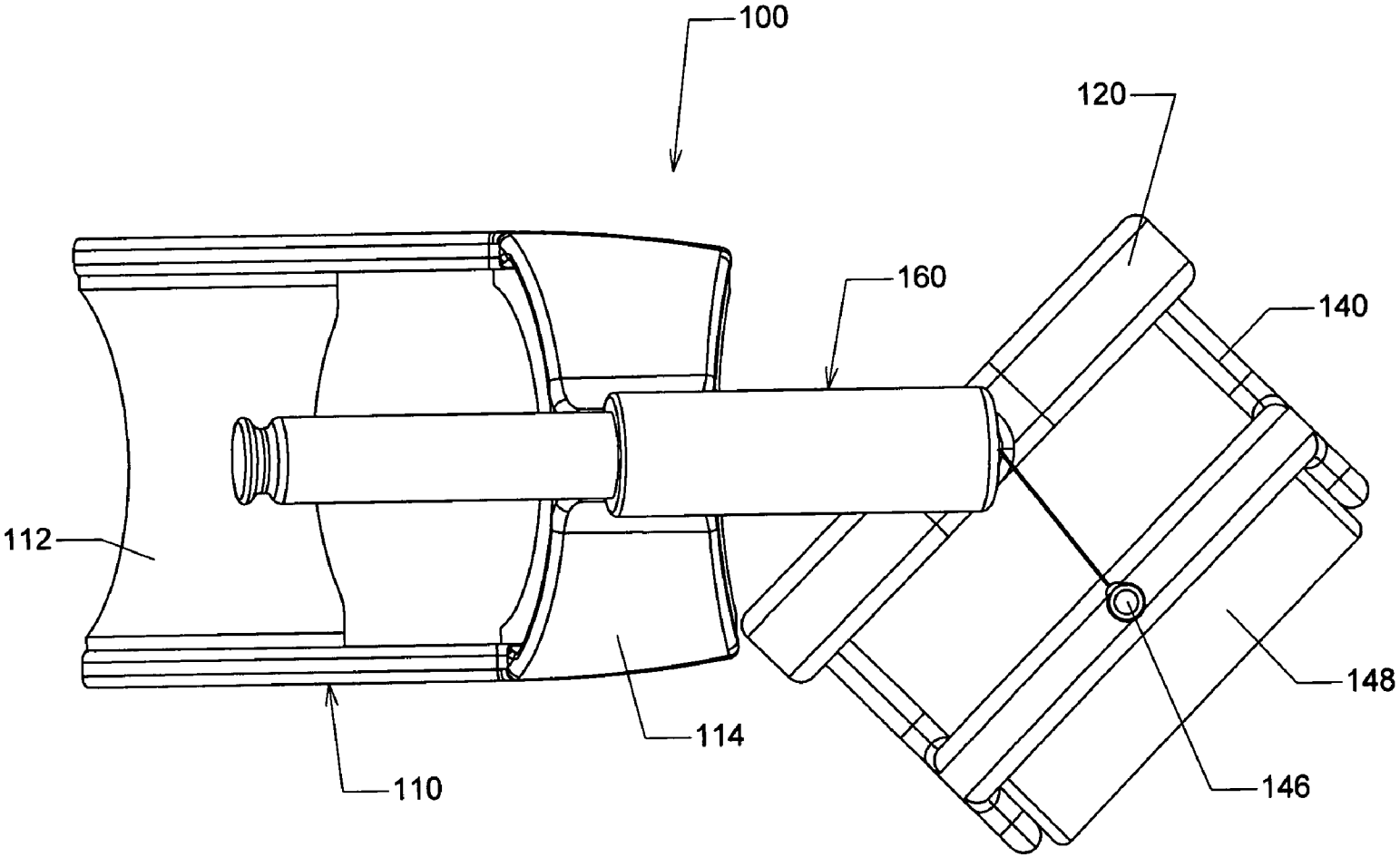
Figure 5A:
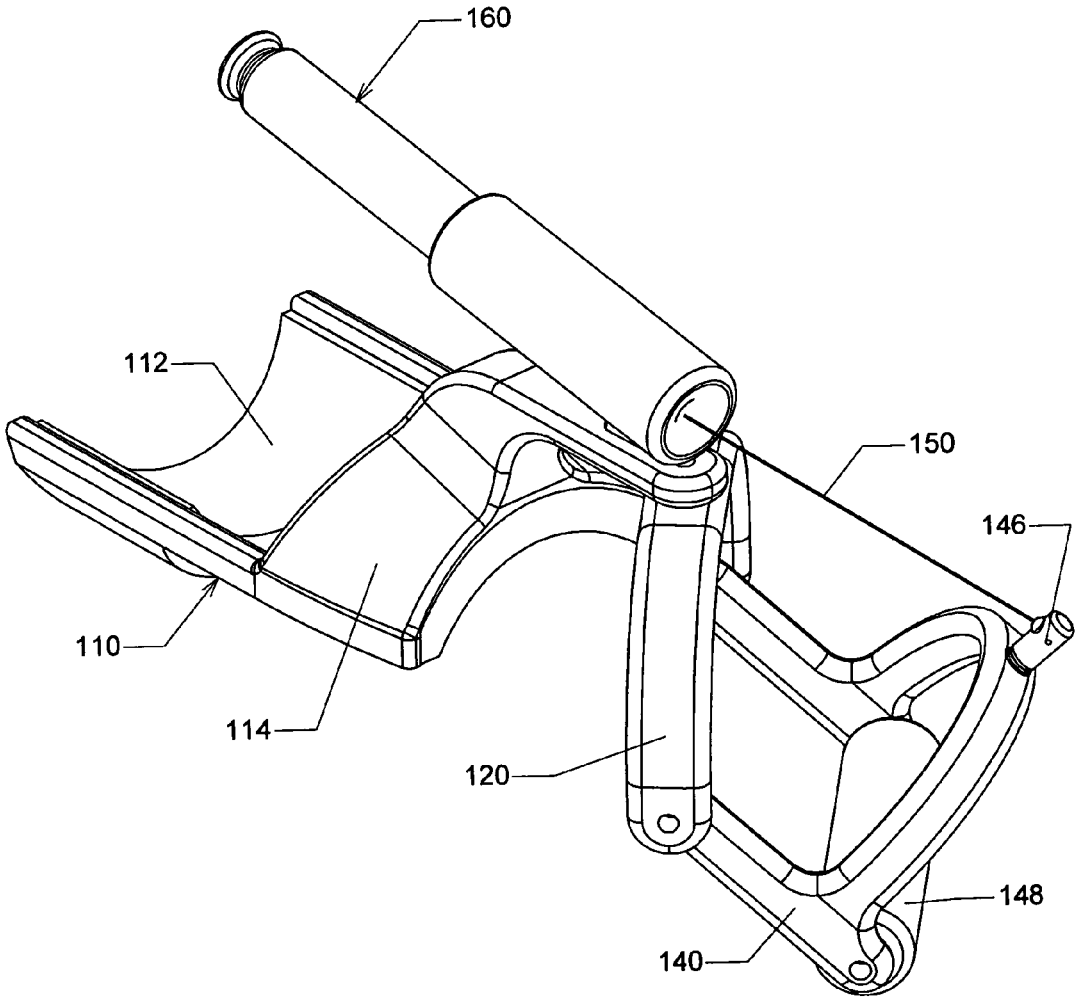
Figure 5B:
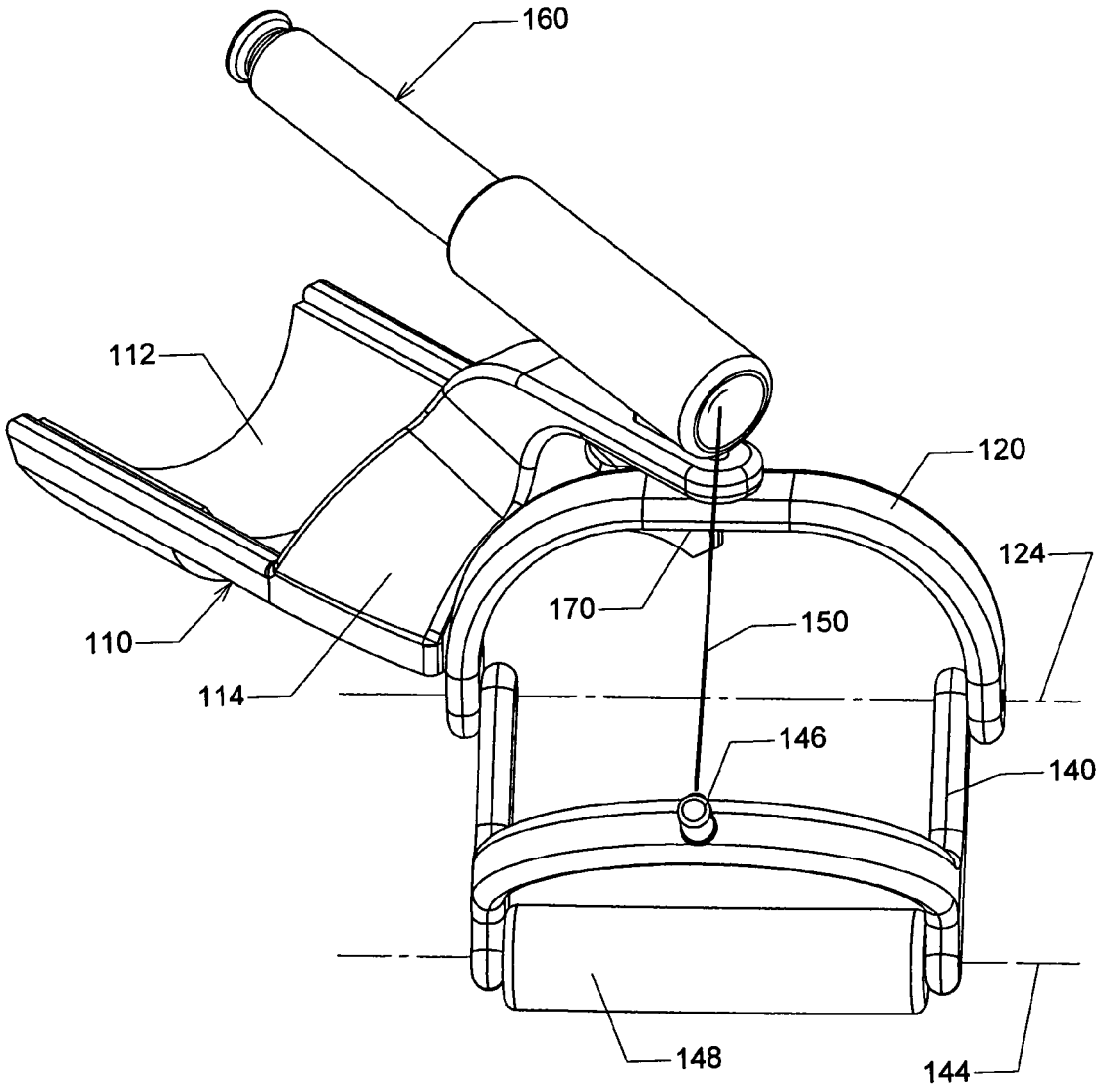
Figure 6A:
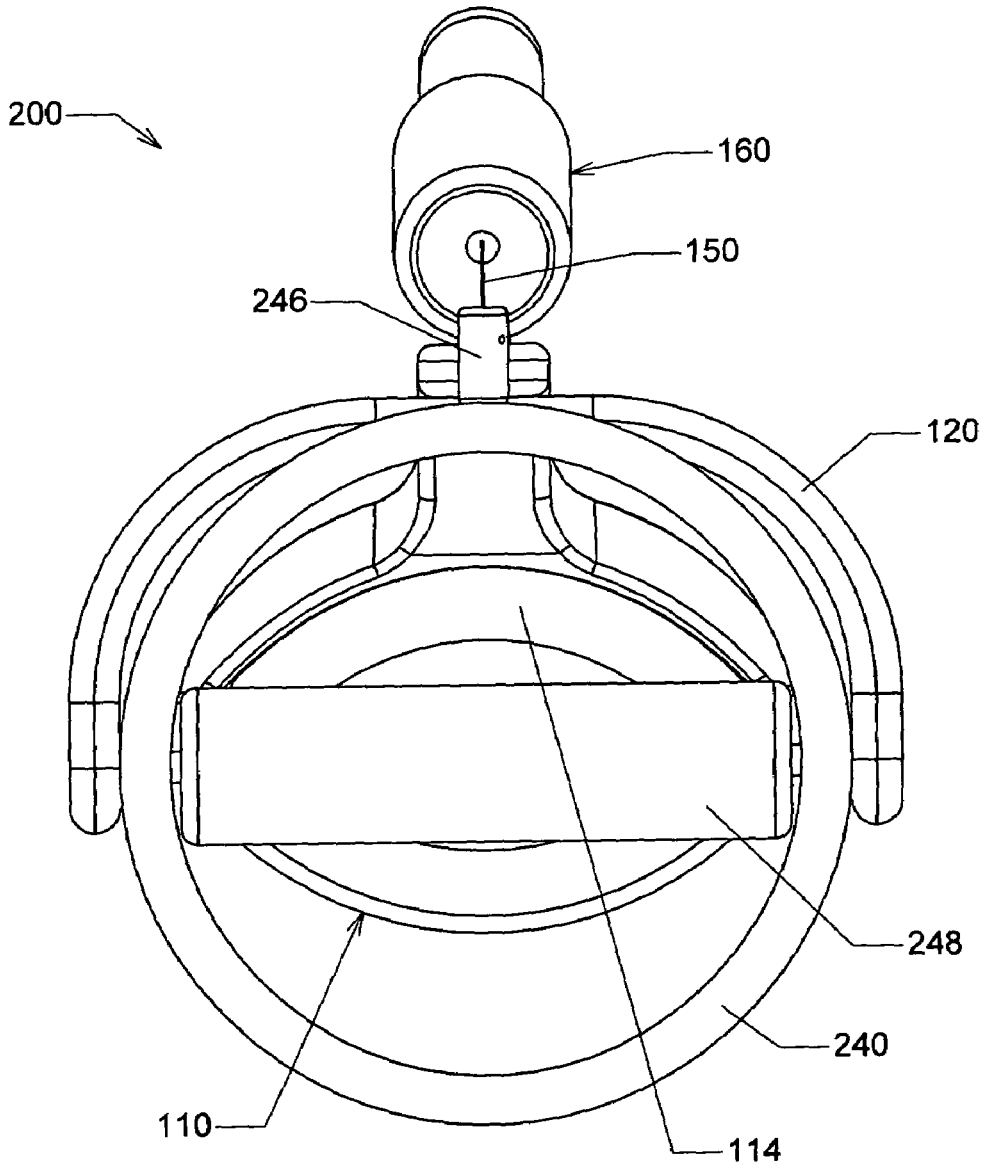
Figure 6B:
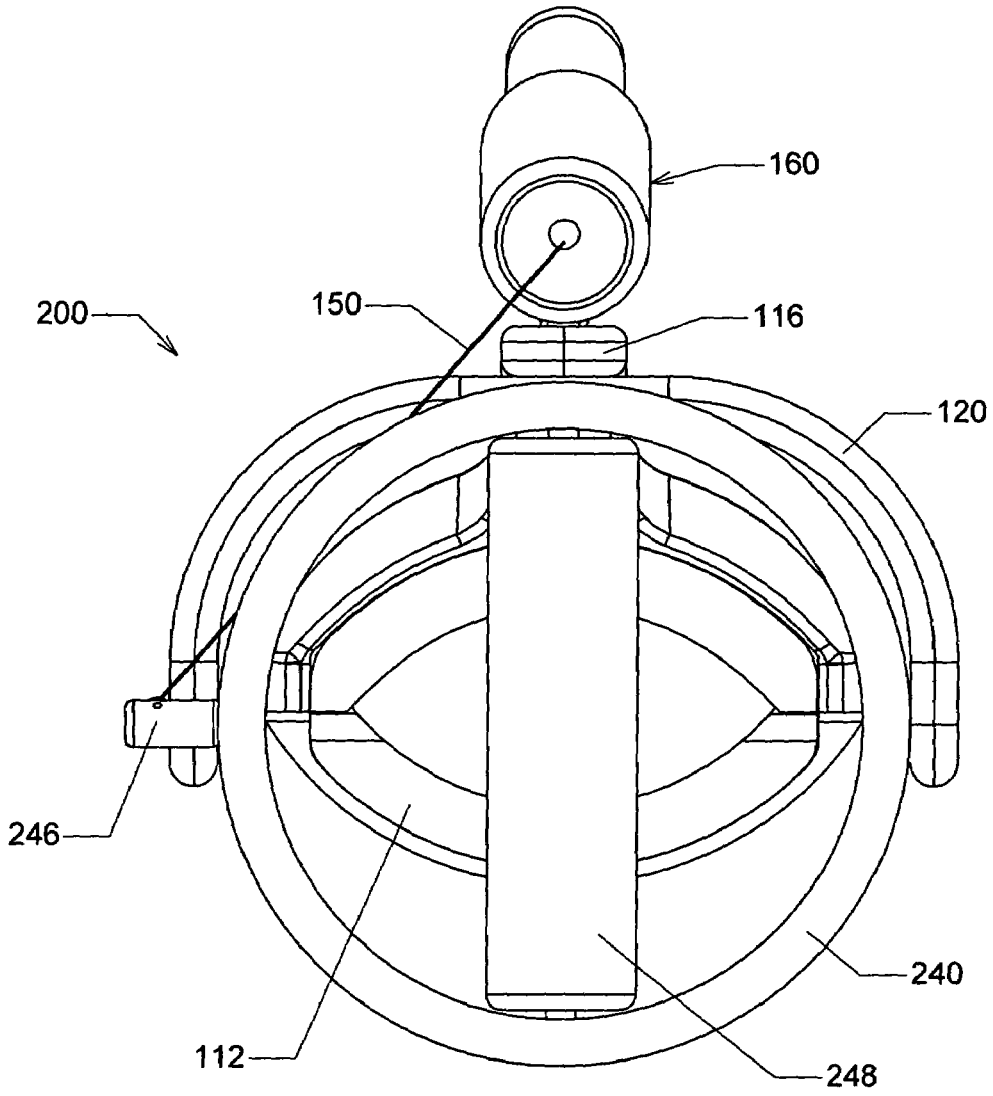

With reference to the Figures of the Drawing, wherein like numerals designate like parts and assemblies throughout the several views, FIG. 1 is a perspective view of an exercise device constructed according to the principles of the present invention, with its handle member in a rest position;

FIG. 2 is a perspective view of an alternative handle member suitable for use on the exercise device of FIG. 1;

FIG. 3*a* is a side view of the exercise device of FIG. 1, with its handle member in a rest position;

FIG. 3*b* is a side view of the exercise device of FIG. 1, with its handle member in deflected downward;

FIG. 4*a* is a top view of the exercise device of FIG. 1, with its handle member deflected to the left;

FIG. 4*b* is a top view of the exercise device of FIG. 1, with its handle member deflected to the right;

FIG. 5*a* is a perspective view of the exercise device of FIG. 1, with its handle member deflected downward and to the left;

FIG. 5*b* is a perspective view of the exercise device of FIG. 1, with its handle member deflected downward and to the right;

FIG. 6*a* is a front view of another exercise device constructed according to the principles of the present invention, with its handle member in a rest position; and FIG. 6*b* is a front view of the exercise device of FIG. 6*a*, with its handle member rotated out of its rest position.

DETAILED DESCRIPTION OF A PREFERRED EMBODIMENT

An exercise device constructed according to the principles of the present invention is designated as 100 in FIGS. 1 and 3*a*–5*b*. The exercise device 100 shares certain attributes with the exercise devices disclosed in U.S. Pat. No. 5,454,769 to Chen and U.S. Pat. No. No. 4,589,655 to Ammon, which patents are incorporated herein by reference. However, the present invention is considered superior to these prior art devices because it facilitates a greater number of exercise movements and/or a wider range of exercise motion.

The exercise device 100 includes a frame 110 configured to engage a person's forearm. A first brace 112 is mounted on a relatively rearward portion of the frame 110, and a second brace 114 is mounted on a relatively forward portion of the frame 110. The braces 112 and 114 provide opposing, concave bearing surfaces that engage opposite sides of a person's forearm.

A handle 148 is movably mounted on a forward portion of the frame 110, either directly (not shown) or via a frame extension 116 mounted on the forward brace 114. On the device 100, an intermediate support 120 is movably interconnected between the frame extension 116 and the handle 148. The intermediate support 120 is a U-shaped member having a central portion that is rotatably connected to the frame extension 116, and opposite leg portions that extend away from the frame extension 116 and defined a gap therebetween. FIG. 3*a* shows an axis of rotation 164 defined between the intermediate support 120 and the frame 110.

The handle 148 is preferably rotatably mounted on a forward end of a handle bracket 140. FIGS. 3*b* and 5*b* show an axis of rotation 144 defined thereby. The handle bracket 140 includes first and second arm portions that extend perpendicularly away from opposite ends of the handle 148 and just inside respective leg portions on the intermediate support 120. Each arm portion is rotatably connected to a respective leg portion. In other words, the intermediate support 120 is interconnected between the frame 110 and the handle 148 in a manner that defines a U-joint. FIGS. 3*b* and 5*b* show an axis of rotation 124 defined between the handle bracket 140 and the intermediate support 120.

A U-shaped bar 145 is rigidly interconnected between the first and second arms on the handle bracket 140. The bar 145 is configured to substantially align with the intermediate support 120 when the device 100 is not in use. A post 146 projects upward from an intermediate portion of the bar 145.

A first end of a cable 150 is connected to the post 146, and an opposite, second end of the cable 150 is connected to a resistance device 160 mounted on the frame extension 116. The resistance device 160 is preferably one of the resistance devices disclosed in the patents incorporated herein by reference. The location of the resistance device 160 on the frame extension 116 may be adjusted (as suggested by the arrows A in FIG. 3*b*) to adjust the magnitude of resistance to certain exercise movements of the handle 148 as compared to the magnitude of resistance to certain other exercise movements of the handle 148, as further explained below.

To use the device 100, a person inserts his hand and forearm between the braces 112 and 114 (with his/her palm facing either toward or away from the post 146), and grasps the handle 148 in his/her hand. As shown in FIGS. 3*a* and 3*b*, a user of the device 100 may then rotate the handle bar 145 away from the intermediate support 120 (about the pivot axis 124). The force associated with this movement must be sufficient to extract the cable 150 from the resistance device 160 to the extent shown in FIGS. 3*a* and 3*b* (the length of exposed cable more than doubles). In this one mode of operation, the device 100 operates in a manner similar to the devices disclosed in the patents incorporated herein by reference.

As shown in FIGS. 4*a* and 4*b*, a user of the device 100 may alternatively rotate both the handle bracket 140 and the intermediate support 120 relative to the frame 110 (about the pivot axis 164). The force associated with this movement must be sufficient to extract the cable 150 from the resistance device 160 to the extent shown in FIGS. 4*a* and 4*b* (the length of exposed cable increases by approximately fifteen percent). Taking into account range of motion and strength associated with a particular direction of motion, it may be considered desirable to provide relatively less resistance to the type of motion depicted in FIGS. 4*a* and 4*b*. In any event, resistance to this particular exercise movement may be somewhat more significantly influenced by the flexibility of the cable 150, as well as the location of the forward end of the resistance device 160 relative to the pivot axis 164.

An optional torsion spring 170 may be interconnected between the intermediate support 120 and the frame 110 to bias the intermediate support 120 toward the "neutral" or rest position shown in FIGS. 1 and 3*a*–3*b*. Among other things, the torsion spring 170 may be used to provide essentially independent resistance to the type of motion shown in FIGS. 4*a* and 4*b*.

As shown in FIGS. 5*a* and 5*b*, a user of the device 100 may also perform the exercise motions of FIGS. 3*a* and 3*b* and FIGS. 4*a* and 4*b* in combination.

FIG. 2 shows an alternative handle bracket 240 that may be substituted for the handle bracket 140 to accommodate still more exercise motions (e.g. pronation). The handle bracket 240 has similar first and second arms that are rotatably connected to respective legs on the intermediate support 120. The arms are rigidly connected to diametrically opposed sides of a first circular ring 241 that defines an inwardly facing race. A second, smaller ring 243 is rotatably secured within the outer ring 241 (by means of ball bearings disposed in aligned races, for example) and cooperates therewith to define an axis of rotation 284. A post 246 is mounted on top of the smaller or inner ring 243 and projects through a slot 242 in the outer ring 241. The post 246 is connected to the cable 150 in the same manner as the post 146 on the handle bracket 140. A handle 248 is rotatably connected to diametrically opposed portions of the inner ring 243.

FIGS. 6*a* and 6*b* show an alternative embodiment 200 of the present invention, wherein the alternative handle bracket 240 has been substituted for the handle bracket 140. As a result, the device 200 allows a person to pronate or twist his forearm either in isolation or in combination with the other exercise motions discussed above. The force associated with the twisting movement must be sufficient to extract the cable 150 from the resistance device 160 to the extent shown in FIGS. 6*a* and 6*b*, as well as FIG. 3*a* (the length of exposed cable more than doubles).

Another embodiment of the present invention may be implemented by modifying the device 200 with a rigid connection between the intermediate support 120 and the frame 110. Such an arrangement would accommodate the type of exercise movement shown in FIGS. 3*a* and 3*b*, and the type of exercise movement shown in FIGS. 6*a* and 6*b*, but not the type of exercise movement shown in FIGS. 4*a* and 4*b*. Yet another embodiment of the present invention may be implemented by modifying the device 200 with a rigid connection between the alternative handle bracket 240 and the intermediate support 120. Such an arrangement would accommodate the type of exercise movement shown in FIGS. 4*a* and 4*b*, and the type of exercise movement shown in FIGS. 6*a* and 6*b*, but not the type of exercise movement shown in FIGS. 3*a* and 3*b*.

The present invention may also be described in terms of various methods which may be performed with and/or based upon the foregoing embodiments. For example, the present invention may be described in terms of an arm exercise method involving the steps of providing a frame that is configured to bear against a person's arm; providing a hand grip that is sized and configured for grasping; movably mounting the hand grip on the frame for movement relative to the frame in both a first direction and a second, orthogonal direction; providing a resistance device; and interconnecting the resistance device between the frame and the hand grip to resist movement of the hand grip relative to the frame.

The present invention may alternatively be described in terms of a method of arm exercise, involving the steps of providing a frame that is configured to bear against a person's arm; providing a hand grip that is sized and configured for grasping; mounting the hand grip on the frame for movement relative to the frame from a rest position to a first position disposed in a first direction from the rest position, and alternatively, to a second position disposed in a second, orthogonal direction from the rest position; and biasing the hand grip to resist movement in at least one said direction away from the rest position.

As a result of the added dimensional movements facilitated by the present invention in its various forms, a person can exercise his/her wrists and forearms in a manner that better approximates real life activity (e.g. a swing in baseball, golf, or tennis). The present invention has been described with reference to specific embodiments which will enable persons skilled in the art to recognize additional embodiments and/or applications which incorporate the essence of the present invention. With the foregoing in mind, the scope of the present invention is to be limited only to the extent of the following claims.

What is claimed is:

1. An exercise device, comprising:

a frame configured to bear against a person's arm;

a hand grip;

a connecting means for connecting the hand grip to the frame in a manner that allows the hand grip to pivot about two perpendicular axes relative to the frame, wherein the connecting means includes a handle bracket interconnected between the frame and the hand grip, and pivotal about at least one of the two axes; and a resistance device interconnected between the frame and the hand grip to resist movement of the hand grip relative to the frame, wherein a flexible cable is interconnected between the handle bracket and the resistance device.

2. The exercise device of claim 1, wherein the frame is configured to form a closed loop about a person's forearm.

3. The exercise device of claim 1, wherein a first end of the resistance device is secured to the frame proximate one of the axes.

4. The exercise device of claim 1, wherein the connecting means connects the hand grip to the frame in a manner that allows the hand grip to pivot about a third axis that extends perpendicular to each of the two axes.

5. The exercise device of claim 1, wherein the frame is configured to extend along the person's forearm and generally parallel to one of the two axes.

6. The exercise device of claim 1, wherein the hand grip defines a longitudinal axis that extends perpendicular to at least one of the two axes.

7. The exercise device of claim 6, wherein the longitudinal axis extends perpendicular to each of the two axes.

8. An exercise device, comprising:

a frame configured to bear against a person's arm;

a hand grip;

a connecting means for connecting the hand grip to the frame in a manner that allows the hand grip to pivot about two perpendicular axes relative to the frame, wherein the connecting means includes a handle bracket that pivots about at least one of the two axes, and the hand grip is rotatably mounted on the handle bracket for rotation about a longitudinal axis defined by the hand grip; and a resistance device interconnected between the frame and the hand grip to resist movement of the hand grip relative to the frame.

9. The exercise device of claim 8, wherein the longitudinal axis extends perpendicular to at least one of the axes.

10. The exercise device of claim 8, wherein a flexible cable is interconnected between the handle bracket and the resistance device.

11. An exercise device, comprising:

a frame configured to bear against a person's arm;

a hand grip that defines a longitudinal axis;

a handle bracket, wherein the hand grip is mounted on the handle bracket for rotation about the longitudinal axis;

an intermediate support, wherein the handle bracket is movably connected to the intermediate support for pivoting about a first pivot axis that extends parallel to the longitudinal axis, and the intermediate support is movably connected to the frame for pivoting about a second pivot axis that extends perpendicular to the first pivot axis; and a resistance device interconnected between the frame and the hand grip to resist movement of the hand grip relative to the frame.

12. The exercise device of claim 11, wherein the hand grip is movably mounted on the handle bracket for pivoting about a third pivot axis that extends perpendicular to both the first axis and the second axis.

13. An exercise device, comprising:

a frame configured to bear against a person's arm;

a hand grip that defines a longitudinal axis;

a handle bracket, wherein the hand grip is movably mounted on the handle bracket for rotation about the longitudinal axis and for pivoting about a first pivot axis that extends perpendicular to the longitudinal axis, and the handle bracket is movably connected to the frame for pivoting about a second pivot axis that extends parallel to the longitudinal axis; and a resistance device interconnected between the frame and the hand grip to resist movement of the hand grip relative to the frame.

* * * * *